US010750294B2

(12) United States Patent
Hatzianestis

(10) Patent No.: US 10,750,294 B2
(45) **Date of Patent: *Aug. 18, 2020**

(54) PREDICTIVE POWER ADJUSTMENT IN AN AUDITORY PROSTHESIS

(71) Applicant: Cochlear Limited, Macquarie University, NSW (AU)

(72) Inventor: Kostas Hatzianestis, Elizabeth Bay, NSW (AU)

(73) Assignee: COCHLEAR LIMITED, Macquarie University, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/975,113

(22) Filed: May 9, 2018

(65) Prior Publication Data

US 2018/0262848 A1 Sep. 13, 2018

Related U.S. Application Data

(63) Continuation-in-part of application No. 13/553,804, filed on Jul. 19, 2012, now Pat. No. 9,980,057.

(51) Int. Cl.
*H04R 25/00* (2006.01)

(52) U.S. Cl.
CPC ..... *H04R 25/505* (2013.01); *H04R 25/554* (2013.01); *H04R 2225/33* (2013.01); *H04R 2225/51* (2013.01); *H04R 2225/67* (2013.01)

(58) Field of Classification Search
CPC ..... H04R 3/007; H04R 25/30
See application file for complete search history.

(56) References Cited

U.S. PATENT DOCUMENTS 5,710,981 A * 1/1998 Kim ..... H04W 52/10 455/127.5
5,741,314 A 4/1998 Daly et al.
5,876,425 A * 3/1999 Gord ..... A61N 1/36185 607/33
5,949,484 A 9/1999 Nakaya et al.
(Continued)

FOREIGN PATENT DOCUMENTS

KR 10-0573622 B1 4/2006
WO 0180795 A1 11/2001
WO 2013076653 A2 5/2013

OTHER PUBLICATIONS

European Exam Report issued in counterpart European Application No. 13820371.6, dated Jan. 4, 2018, 6 pgs.
(Continued)

*Primary Examiner* — Amir H Etesam
(74) *Attorney, Agent, or Firm* — Edell, Shapiro & Finnan, LLC

(57) ABSTRACT

Presented herein are techniques for adjusting one or more configuration parameters of an auditory prosthesis based on at least a predicted power demand in an internal unit/component of the auditory prosthesis. The auditory prosthesis may be configured to measure one or more characteristics of an acoustic/sound signal received by the auditory prosthesis and adjust one or more configuration parameters of the auditory prosthesis based at least a predicted power demand in the internal unit derived from the one or more measured characteristics of the acoustic signal.

32 Claims, 7 Drawing Sheets

(56) References Cited

U.S. PATENT DOCUMENTS

| | | | | |
|---|---|---|---|---|
| 6,351,189 | B1 * | 2/2002 | Hirvilampi | H03F 1/0261 330/296 |
| 6,537,200 | B2 | 3/2003 | Leysieffer et al. | |
| 8,144,908 | B2 | 3/2012 | Asnes | |
| 2004/0131214 | A1 | 7/2004 | Galler et al. | |
| 2004/0247148 | A1 | 12/2004 | Pedersen | |
| 2005/0094834 | A1 | 5/2005 | Chalupper | |
| 2006/0184213 | A1 | 8/2006 | Griffith | |
| 2007/0118185 | A1 | 5/2007 | Shaquer | |
| 2008/0132750 | A1 | 6/2008 | Miller et al. | |
| 2013/0129125 | A1 * | 5/2013 | Meskens | H04R 25/606 381/314 |
| 2016/0044427 | A1 | 2/2016 | Meskens et al. | |

OTHER PUBLICATIONS

Partial Supplemental European Search Report dated Feb. 17, 2016 in European Application No. 13820371.6-1901.
International Search Report. PCT/IB2013/055887. dated Mar. 12, 2014.

* cited by examiner

PREDICTIVE POWER ADJUSTMENT IN AN AUDITORY PROSTHESIS

CROSS REFERENCE TO RELATED APPLICATION

The present application is a continuation in part application of U.S. patent application Ser. No. 13/553,804, filed on Jul. 19, 2012, the entirety of which is hereby incorporated by reference herein.

BACKGROUND

The present disclosure relates generally to the provision of power to an implanted medical device, and more particularly, to the provision of power to an auditory prosthesis.

Many implantable medical devices, such as auditory prostheses, are active implantable medical devices (AIMDs) which consume power. Such devices require power to be transferred from an external unit to an implanted unit. More recently, this transfer of power is generally performed transcutaneously since percutaneous leads may cause discomfort to and may be a potential source of infection.

The electronics in an auditory prosthesis typically consumes a small portion of the total electrical power consumed by the implantable unit of the prosthesis. The auditory prosthesis' components which are involved in sound amplification and generation consume the largest proportion of the implant's available power. Their power characteristic is generally dependent on the instantaneous sound intensity that is required during the implant's operation.

The radio-frequency (RF) signal sent to the implanted unit transfers energy that is used to power the implanted unit. Intermittencies can occur in the implanted unit's operation if insufficient power is transmitted to the implanted unit. On the other hand, excessive power can be consumed in the implanted unit if the power-determining parameters are too high. The intermittencies are the result of temporal modulations in the implanted unit's unregulated voltage, which technically represent an imbalance between power supplied to the implant and actual load demand.

The power in the RF signal is adjusted to avoid underpowering the implanted unit, i.e., to try to maintain a sufficient energy margin in the implant's tank capacitance and regulator. The power in the RF signal also is adjusted to avoid transients that overpower the implanted unit, i.e., to avoid circumstances in which the implanted unit's overvoltage protection circuits are in conduction.

A measurement of the implant's unregulated voltage and current, in some cases, is telemetered back periodically to the external speech processor (SP) to assist in the power level adjustment of the RF (carrier amplitude at resonance).

SUMMARY

In one aspect, a method performed at an auditory prosthesis having an external unit and an internal unit for implantation in a recipient is provided. The method comprises: measuring one or more characteristics of an acoustic signal received by the auditory prosthesis; adjusting one or more configuration parameters of the auditory prosthesis based at least a predicted power demand in the internal unit derived from the one or more measured characteristics of the acoustic signal; processing the acoustic signal to generate encoded control signals for transcutaneous transmission to the internal unit; and transcutaneously transmitting the encoded control signals to the internal unit via signals generated based on the one or more configuration parameters which determine the amount of energy transmitted in the encoded signal depends on the at least one parameter.

In another aspect, an auditory prosthesis is provided. The auditory prosthesis comprises: a sound processor configured to measure at least one characteristic of a received sound signal and to generate an encoded signal representative thereof; a radio frequency (RF) transmitter configured to transmit an RF signal according to the encoded signal; and a controller configured to adjust, based at least on the measured at least one characteristic of the received sound signal, at least one operating parameter of the prosthesis, wherein the operating parameter affects power consumption of the auditory prosthesis.

In another aspect, an auditory prosthesis is provided. The auditory prosthesis comprises: a sound processor configured to measure at least one characteristic of a sound signal received at the auditory prosthesis; a transmitter configured to transmit an encoded signal derived from the sound signal to an internal unit implanted in a recipient; and a controller configured to adjust a at least one parameter of the transmitted signal so as to vary an amount of energy transmitted in the encoded signal based on the characterized sound signal.

DETAILED DESCRIPTION

Presented here are techniques for dynamically predicting the power demand of an implantable, internal unit of an auditory prosthesis based at least on characteristics of a received sound, and to dynamically adjust prosthesis parameters in anticipation of higher or lower power demand in the internal unit, in particular its actuator(s).

Figure 1:
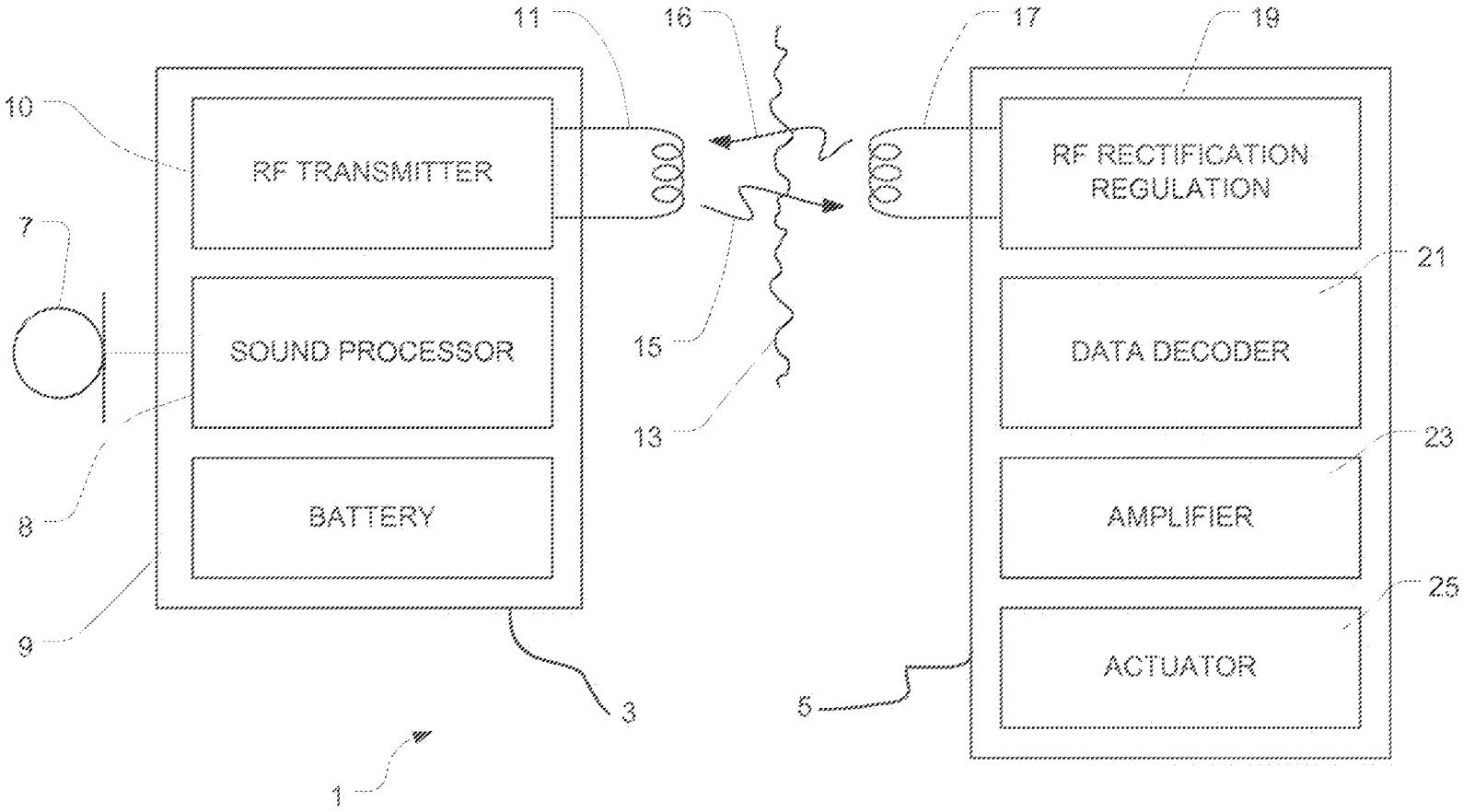
FIG. 1 is a simplified block diagram of an auditory prosthesis, according to an embodiment of the present disclosure.

FIG. 1 is a simplified block diagram of an auditory prosthesis 1, according to an embodiment of the present disclosure. In FIG. 1, the auditory prosthesis 1 includes an external unit 3 and an implantable (internal) unit 5, sometimes referred to as "implant" 5. External unit 3 has a microphone 7, a sound processor 8 and a radio frequency (RF) transmitter 10. Auditory prosthesis 1 is powered by a battery 9 located in the external unit 3. A voltage regulator (not shown) controls the voltage supplied to the sound processor 8 and RF transmitter 10. Since the external unit 3 is typically worn behind the recipient's ear, there is a constraint on the size and weight of the external unit. Consequently there is a need for efficient usage of the power generated by battery 9.

The RF transmitter 10 transmits a radio frequency signal 15 through the recipient's skin 13, using inductively coupled external and internal coils 11 and 17, respectively. The RF signal 15 is received by the internal coil 17 that is located so as to enable inductive coupling with the external coil 11, and provided in some form to other components of the internal unit 5 of prosthesis 1. In some arrangements, an RF signal 16 is also transmitted from the internal unit 5 to the external unit 3, for example to provide information about the status of the internal unit 5.

FIG. 1 illustrates some functional units of the implantable part 5, including circuitry 19 that rectifies and regulates the received RF signal 15. As described below with reference to FIG. 3, the energy received via the received RF signal 15 serves to charge up a tank capacitor 104 (see FIG. 3, discussed below) that is used to power the internal unit 5.

The internal unit 5 also includes a data decoder 21; an amplifier 23; and an actuator 25. The data decoder 21 extracts the data which is encoded in the received RF signal 15. The amplifier 23 drives the actuator 25 based on the decoded data. The actuator 25 may, for example, include an array of electrodes (not illustrated) that stimulate the auditory nerve of the cochlea. In other arrangements, the actuator 25 may be an electro-acoustical transducer, or an electromechanical transducer that generate a linear movement to provide mechanical stimulation. For example, an electromechanical instance of the actuator 25 may be implanted in the middle ear, with a diaphragm that acts to move the fluid in the cochlea to stimulate the cochlea and auditory nerve. In some arrangements, the actuator 25 may be an electromechanical transducer that impart mechanical vibrations to the bone of the recipient's skull, with the bone transmitting the vibrations by conduction to the inner ear.

Figure 2:
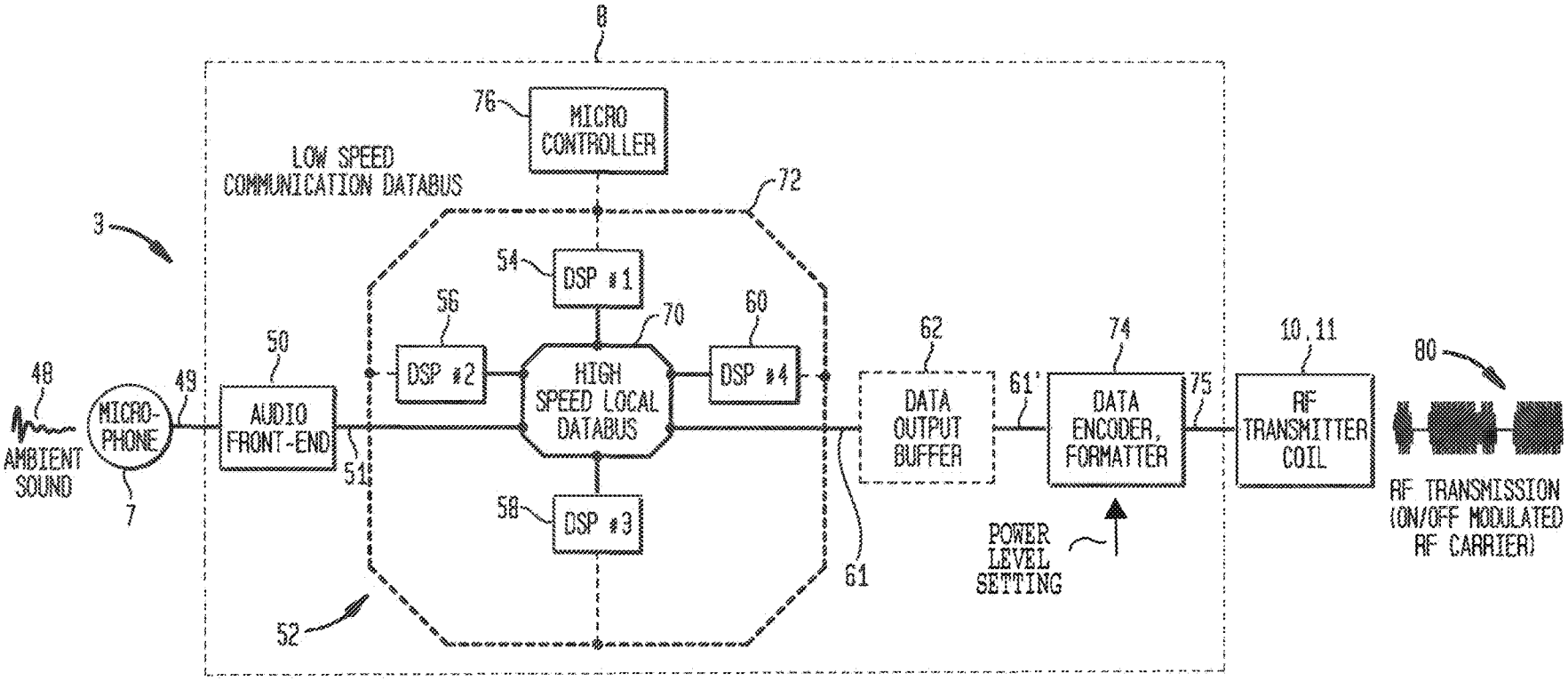
FIG. 2 is a schematic block diagram, according to another embodiment of the present disclosure, illustrating an external unit of an auditory prosthesis, e.g., the prosthesis illustrated in FIG. 1.

FIG. 2 is a schematic block diagram, according to another embodiment of the present disclosure, illustrating an external unit of an auditory prosthesis, e.g., the external unit 3 of the auditory prosthesis 1 of FIG. 1. In an auditory prosthesis, received ambient sound 48 is converted into an electrical signal by the microphone 7, which is digitally processed/analyzed by the sound processor 8 to generate control signals which are provided to the internal unit 5 via the noted induction link. In response to these control signals, the internal unit 5 generates acoustic, mechanical and/or electrical stimulation signals which are delivered by the actuator 25 to cause a hearing percept. The total time, from the point of capturing the sound to causing the hearing percept, is referred to as the group delay of the auditory prosthesis. It is advantageous for the group delay not to exceed 10 ms so that the hearing percepts induced by the auditory prosthesis do not suffer a discernable phase lag relative to the recipient's observations of a speaker's lip movements, which otherwise would compromise the recipient's lip-reading ability.

As noted, the sound 48 is captured by microphone 7. An audio front-end block 50 of sound processor 8 amplifies and filters the electrical audio signal 49 generated by microphone 7 against unwanted noise and converts the signal 49 from analog to digital form thereby generating a digital signal 51. The microphone 7 can be a bi-directional microphone or a microphone array/cluster that is used to achieve a fixed directionality, or beam-former-like adaptive directionality. In some embodiments, the sound signal 48 can be sampled, e.g., equidistantly, in the time-domain such that the sampling rate is at least double the maximum anticipated signal bandwidth. For example, a fixed data quantization (bit-width) can be used. The audio samples may be stored in an intermediate data buffer (not illustrated) that resides within audio front-end 50, or in another suitable remote data buffer.

The digital signal 51 is then processed by a cluster 52 of signal processors that implement various algorithms, for example (and, e.g., in order of a sequential execution): a) time-domain pre-processing, b) sound intensity based power level estimation, c) signal channelization via frequency analysis and d) feature extraction of the audio signal. In the illustrated example of FIG. 2, the cluster 52 includes four digital signal processors (DSPs) 54, 56, 58, 60. The DSPs 54-60 operate, e.g., concurrently, to execute, e.g., the above-noted four types of processing algorithms, and exchange data via a data bus 70. A supervising microcontroller 76 programs and configures in real-time the parameterization of the DSPs 54-60 via a data bus 72. On a relative basis, data bus 70 is higher speed as compared to data bus 72. For example, data bus 70 can be a time-shared high-speed bit-parallel data bus, whereas data bus 72 can be a low-speed bit-parallel or serial interface 72. The audio data processed by the DSP cluster 52 is output as a signal 61 and may be stored in an optional (as denoted by phantom lines) output buffer 62.

A data encoder and formatter 74 receives the processed audio data as a signal 61' from the output buffer 62 at a frame rate that is programmed by the supervising microcontroller 76. These quantized digital data are broken up into chunks of data bits that are individually mapped into appropriately defined data bit combinations with higher code disparity. The data formatter block 74 adds protection bits to the final bit combinations, and the prepared data stream 75 is serially transmitted by the RF transmitter 10 that includes a tuned circuit (not illustrated) and the RF coil 11. The transmitted RF signal 80 in the illustrated example is an on/off modulated RF earner.

Figure 3:
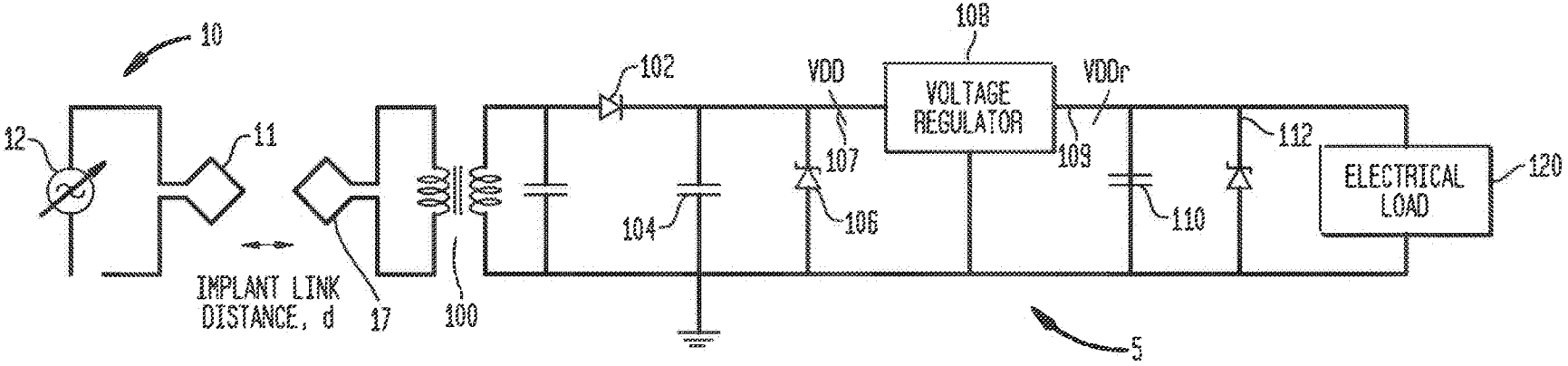
FIG. 3 is a simplified circuit diagram, according to another embodiment of the present disclosure, of the prosthesis of FIG. 1 illustrating the RF rectification and regulation functional block in an implantable unit of the prosthesis.

FIG. 3 is a simplified circuit diagram, according to another embodiment of the present disclosure, illustrating selected hardware blocks that are involved in the transfer of electrical power from an external unit of an auditory prosthesis to an internal unit thereof, e.g., from the external unit 3 to the internal unit of the auditory prosthesis 1.

The RF transmitter 10 includes an RF source 12 (generating a carrier signal, e.g., at 5 MHz) connected to the transmitter coil 11. RF transmitter 12 operates with an electrical voltage that varies over time as battery energy is depleted in the external unit 3. The external unit 3 includes a mechanism to adjust the Power Level (PL) of the RF carrier, expressed in percentage ranges from, e.g., 50 to 100%. In one arrangement, the sound-intensity-based power level estimation results in a power level adjustment being made to pulse width modulation of the signal that is used to excite the tuned circuit in the transmitter block. The sound-intensity-based power level estimation and the resulting power level adjustment are implemented, for example as algorithms (e.g., dedicated algorithms) in the DSP cluster 52.

The separation distance between the external and internal coils 11 and 17, respectively, is determined by the recipient's skin flap thickness and is typically between about 0 mm to about 10 mm. This separation distance affects the transfer of electrical energy to the internal unit 5 (link efficiency k) and modulates the electrical voltage that is generated in the internal unit 5. The skin flap thickness is determined during surgery and is confirmed during the initial programming session for each recipient individually, for example by examining the correctness of the implant's telemetry over a power level range. The skin flap thickness is used as a primary variable in the real-time calculation of the power level setting (e.g., see block 207 discussed below) based on the instantaneous sound intensity.

The internal unit 5 extracts the electrical energy that is necessary to sustain its essential functionality by rectifying the received RF signal, using a transformer 100 and a diode 102, and storing the extracted energy in a tank capacitor 104. The voltage across the tank capacitor is denoted $V_{DD}$, and represents the unregulated voltage 107 of the internal unit 5. The unregulated voltage 107 is stabilized by a voltage regulator 108 so that the data decoder 21, the amplifier 23 and the actuator 25 operate with substantially constant supply voltages. The output voltage 109 of regulator 108 is denoted VDDr and represents the regulated voltage of the internal unit 5.

A primary voltage protection diode 106, e.g., a zener diode, is provided between the input of the voltage regulator 108 and the electrical ground of internal unit 5. The diode 106 shunts excess voltages that might be generated by external sources to a level that is considered safe for the operation of the internal unit 5. The shunted energy may be a significant contributor to the electrical power losses suffered by the internal unit 5. The sound-intensity-based power level estimation provides a power level adjustment such that the unregulated voltage 107 is maintained at or below the breakdown region of the zener diode 106. The diode's characteristic relating electrical current to voltage shunting is non-linear. Generally, the conduction characteristic of zener diode 106 varies from due to manufacturing-related tolerances. In embodiments in which the diode 106 is a zener diode, the typical tolerance is +/− about 5% around the diode's rated breakdown voltage.

An output capacitor 110 is provided between the output of voltage regulator 108 and electrical ground. A secondary voltage protection diode 112 is provided in parallel with output capacitor 110. The regulated voltage 109 drives electrical load 120, which includes the data decoder 21, amplifier 23 and actuator 25.

Figure 4:
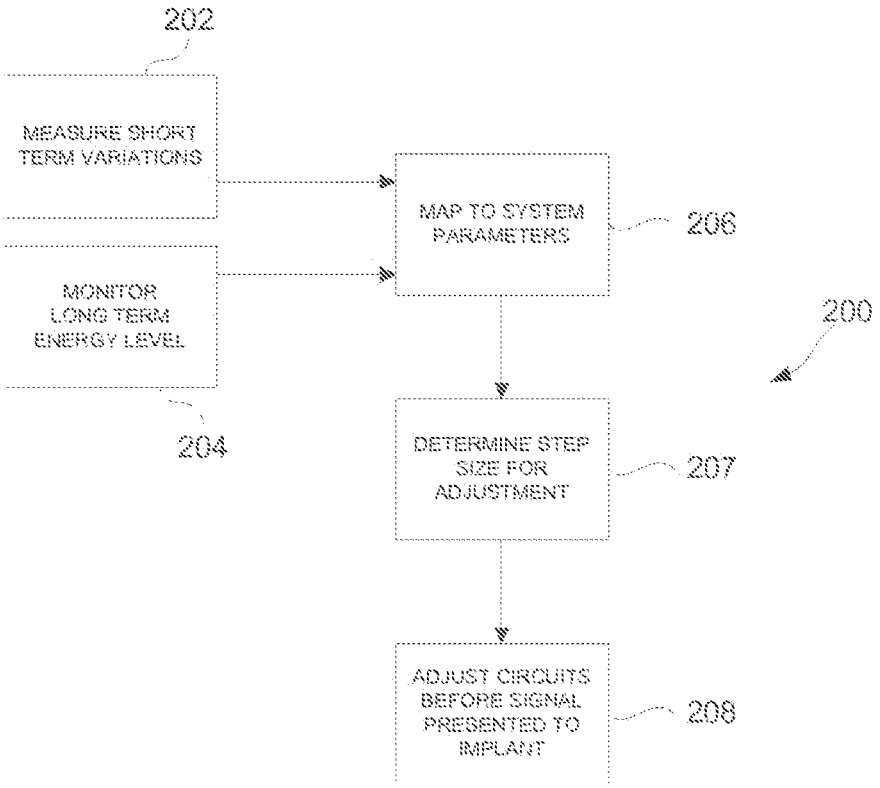
FIG. 4 is a flow chart illustrating a method, according to another embodiment of the present disclosure, of adjusting system parameters of an auditory prosthesis in anticipation of higher or lower power demand in the implantable unit.

FIG. 4 is a flow chart illustrating a method 200, according to another embodiment of the present disclosure, that that may be implemented to predict power demand of auditory prosthesis based on the characteristics of the received ambient sound 48, and dynamically adjust system parameters in anticipation of the predicted power demand in the internal unit of the auditory prosthesis, e.g., in the internal unit 5 of the auditory prosthesis 1.

At block 202, an on-going process is performed by sound processor 8 to measure the onset of transient events in the audio signal 49 that may indicate a possible change in the intensity (short-term variations) of the sound signal 48. At block 204, the sound processor 8 monitors the long-term energy level of the audio signal 49 in the processing pipeline of external sound processor 8. Blocks 202 and 204 are implemented, e.g., by digital software or firmware in sound processor 8 operating on time- or frequency-domain compound or channelized audio information according to the algorithms which are implemented in one or more of the DSP units 54-60, e.g., the DSP units 54 and 56. As an example, in an all-digital implementation, the transient detection is based on a differentiator digital filter that operates in the time-domain and processes low-pass filtered audio samples. The low-pass filter is, e.g., a finite-impulse response type of digital filter that exhibits an out-of band attenuation of at least about 60 dB, pass-band ripple of about 3 dB, and has a transition bandwidth of about $I/10^{th}$ that of the filter's overall bandwidth. For execution economy, the filter can be implemented as a multi-rate filter using sub-sampling and effective reduction of the bandwidth in the audio signal's band of interest. The estimation techniques of blocks 202 and 204 can be also implemented, e.g., using temporal features extracted from the audio signal using a frequency estimation method such as a digital Fourier transform (FFT), multirate filterbank, wavelet transform, etc.

In block 206, algorithms operating in one of the DSP units 54-60, e.g., the DSP cluster 58, map the measured short-term and long-term intensities to derive appropriate settings for one or more system parameters. In block 207, a suitable increment size for a change in configuration parameters may be determined, as discussed in more detail below. In block 208, the configuration parameters of the auditory prosthesis 1 are adjusted in real-time according to the derived parameter settings and step sizes. The adjustment is performed in anticipation of the power demand in the internal unit 5, before the audio signal is presented to the data decoder 21, the amplifier 23 and actuator 25.

Method 200 thus provides the dynamic adjustment of configuration parameters of the auditory prosthesis 1 that impact the total power consumption and efficiency as a function of a predicted intensity and transient characteristic of the sound 48. The configuration parameters of the implant system that may be dynamically adjusted include: the amplitude of the RF carrier provided by the RF source 12 and used by the RF transmitter 10; the on/off duty cycle of the RF signal 80; the output voltage of the voltage regulator (not illustrated) serving the sound processor 8 and the RF transmitter 10; the rate at which RF frames are transmitted from the external unit 3 to the internal unit 5; and the quantization (bit-width) and digital encoding (e.g., signed-magnitude, 12 or 2 s complement) of the data in the payload of the RF frames, which encode the audio signal in the forward channel.

As noted, FIG. 4 generally illustrates the adjustment of configuration parameters of the auditory prosthesis 1 that impact the total power consumption and efficiency as a function of a predicted intensity and transient characteristic of the sound 48 (i.e., adjustments based at least on measured characteristics of received sound signals). However, it is to be appreciated that, in certain embodiments, configuration parameters of the auditory prosthesis 1 may also be adjusted based on additional information.

For example, in certain embodiments, the method of FIG. 4 may further comprise determining a manufacturer-specific attribute of the implant/internal unit 5 (e.g., the implant type, the implant revision, the implant series-number, etc.). In these embodiments, the configuration parameters of the auditory prosthesis 1 may also or alternatively be adjusted based on these manufacturer-specific attributes of the internal unit 5.

As described elsewhere herein, the RF transmitter 10 includes an RF source 12 which generates a RF signal 15 that is used to transcutaneously transmit encoded control signals to the internal unit 5 via external coil 11. The RF signal 15 is received by the internal coil 17 in the internal unit 5 of prosthesis 1. In certain examples, the method of FIG. 4 further includes determining one or more attributes of the internal coil 17 (e.g., the type of material, such as gold, platinum, etc., used to form the internal coil). In these embodiments, the configuration parameters of the auditory prosthesis 1 may also or alternatively be adjusted based on the one or more attributes of the internal coil.

As noted, auditory prosthesis 1 includes sound processor 8 which is configured to digitally process/analyze ambient sound 48 received by microphone 7 in order to generate control signals which are provided to the internal unit 5 via the noted induction link. In certain embodiments, the sound processor 8 may be further configured to use the ambient sound 48 to perform an environmental classification of the ambient environment of the auditory prosthesis 1. That is, the sound processor 8 includes an environmental classifier (e.g., one or more processing elements implementing firmware, software, etc.) configured to determine an environmental classification of the sound environment (i.e., determines the "class" or "category" of the sound environment) associated with the ambient sound 48. In one illustrative example, the environmental classifier 131 is configured to categorize the sound environment into one of five (5) categories, including "Speech," "Speech in Noise," "Quiet," "Noise," and "Music," although other categories are possible. In these embodiments, the configuration parameters of the auditory prosthesis 1 may also or alternatively be adjusted based on the environmental classification of the ambient environment of the auditory prosthesis 1.

Figure 5A:
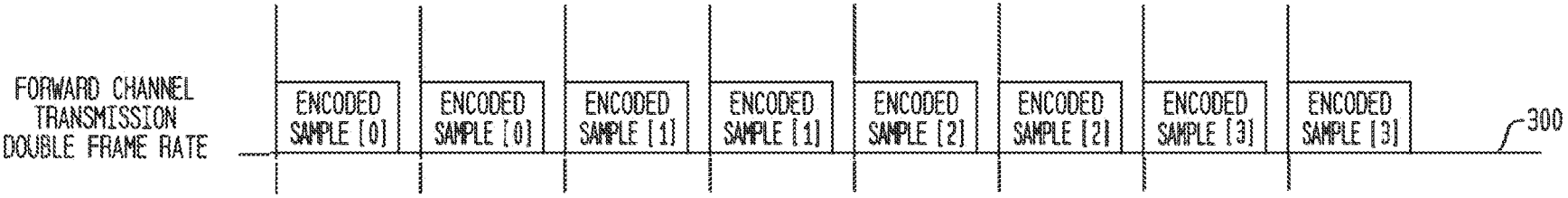
FIGS. 5A-C illustrate a method, according to another embodiment of the present disclosure, in which the frame rate transmitted from the external unit to the internal unit 5 of an auditory prosthesis is adapted/varied according to the instantaneous sound intensity and predicted demand in the internal unit's electrical power.
Figure 5B:
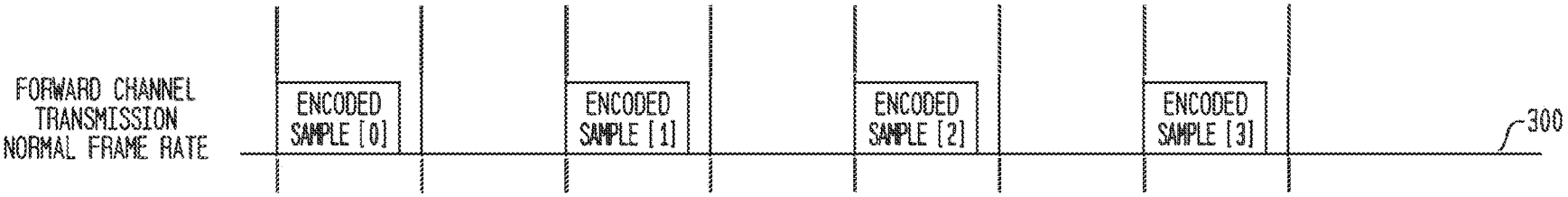
Figure 5C:
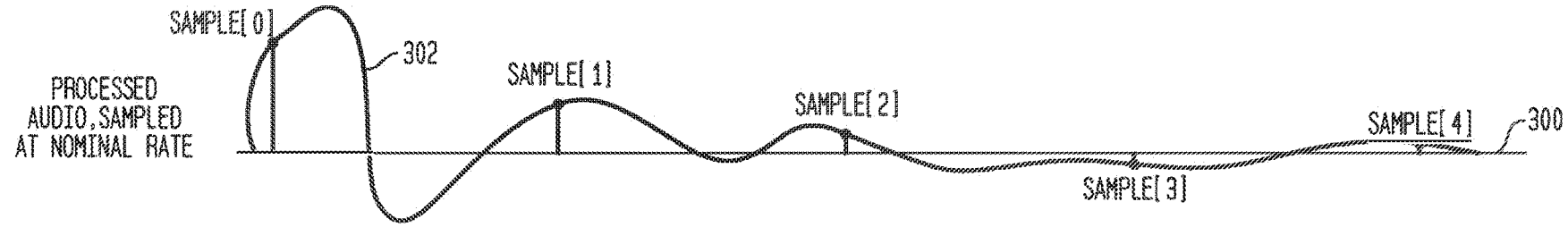

FIGS. 5A-5C illustrate a method, according to another embodiment of the present disclosure, in which the frame rate transmitted from the external unit 3 to the internal unit 5 is adapted/varied according to the instantaneous sound intensity and predicted demand in the implant's electrical power. The frame rate determined in DSP cluster 52 is, e.g., programmable.

FIG. 5C shows an example of an input audio signal 302. The x-axis 300 in FIGS. 5A-5C represents time. The input signal 302 is sampled at regular intervals, with samples [OJ-[4J shown in the example. The sampling rate is at least twice the expected bandwidth of the audio signal 302. FIG. 5B shows the forward channel transmission at the default frame rate of the sound processor 8. Each sample is encoded into a respective frame (i.e., encoded sample [OJ, encoded sample [1], etc.) which is transmitted in turn by the RF transmitter 10 to the internal unit 5. In the example, each frame has a duration that is less than half of the time between samples.

FIG. 5A shows an example of a double-frame rate mode in which the data formatter 74 executes its operation at twice the default sampling rate, for example at 40 k frames/sec compared with a nominal rate of 20 kSamples/sec. In this double-frame mode, the data formatter 74 repeats each audio sample, i.e., outputs each audio sample twice. Thus, the encoded sample [0] is transmitted twice, etc. The data decoder 21 operates, e.g., at the default sampling rate so that the original data may be readily decoded. However, the double frame mode provides increased total RF energy to the internal unit 5.

The scalable frame rate adjustment might include, e.g., any integer multiples of the sampling rate of the audio signal. The double-frame rate is one example of the scalable frame rate. The scalable frame rate method might be implemented, e.g., such that the frame rate is constant in the short term, or in a multi-rate fashion to better match the estimated power demand in the implantable part of the system.

Alternatively, e.g., the data formatter 74 inserts audio samples which are zero-valued with every other data frame. The configuration of the data formatter 74 in regards to its mode of operation occurs via the supervising microcontroller 76 and changes in the configuration can be implemented, e.g., on-the-fly. The frame rate is based, e.g., on the audio intensity (power level) estimate which is calculated in the DSP cluster 52. Thus, for example, if a greater audio intensity is predicted, the frame rate is increased, and vice versa.

Figure 6A:
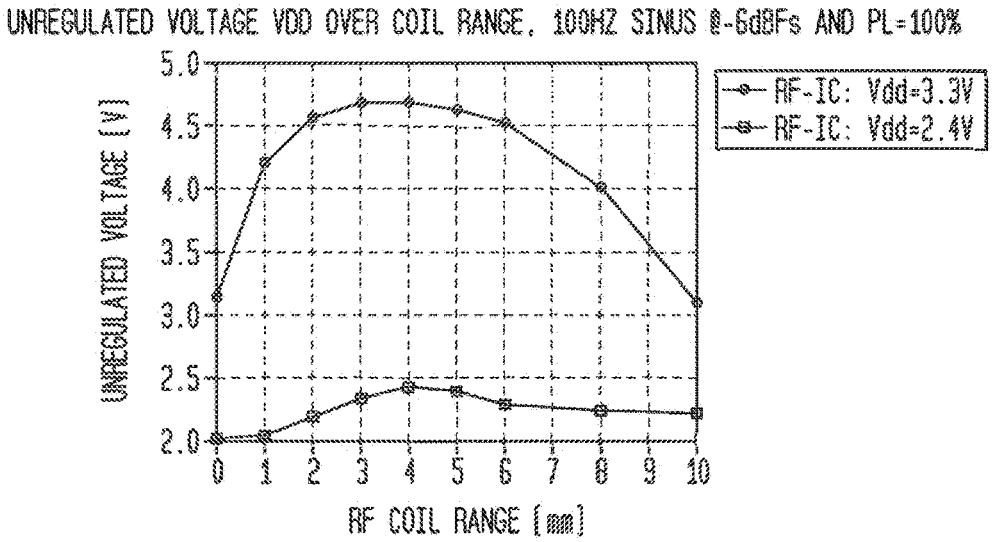
FIGS. 6A-6C are graphs plotting how the internal unit's unregulated voltage varies as a function of the link distance between the external and internal coils.

FIG. 6A are graphs plotting the characteristic of the unregulated voltage ($V_{DD}$) of the internal unit 5 as a function of the link distance d between the external coil 11 and the internal coil 17. Two curves are plotted, corresponding to two different values, e.g., 2.4V and 3.3V, of the supply voltage (RF IC Vdd) of the RF transmitter 10. In this graph, the sound processor 8 operates with a power level PL=100% in regards to the RF transmitter 10 power level, and the internal unit 5 processes a sinusoidal audio signal with a fundamental frequency of 1,000 Hz and an amplitude equal to −6 dB relative the full scale in the dynamic range of the digital signal 51.

Figure 6B:
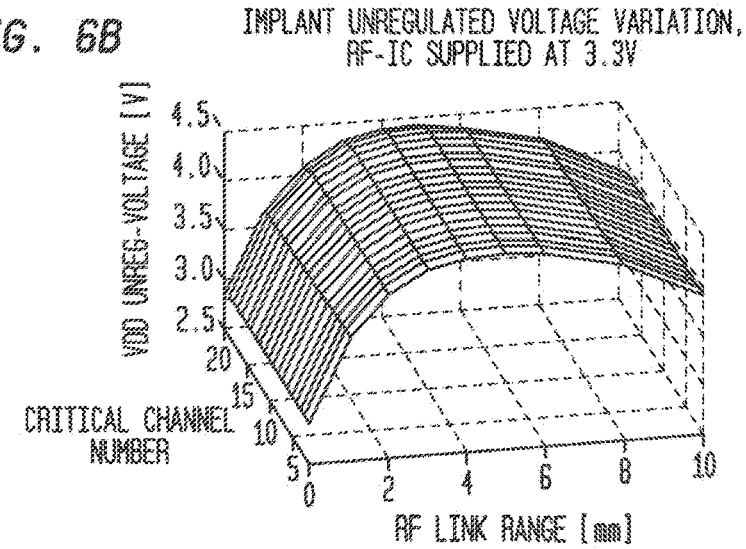
Figure 6C:
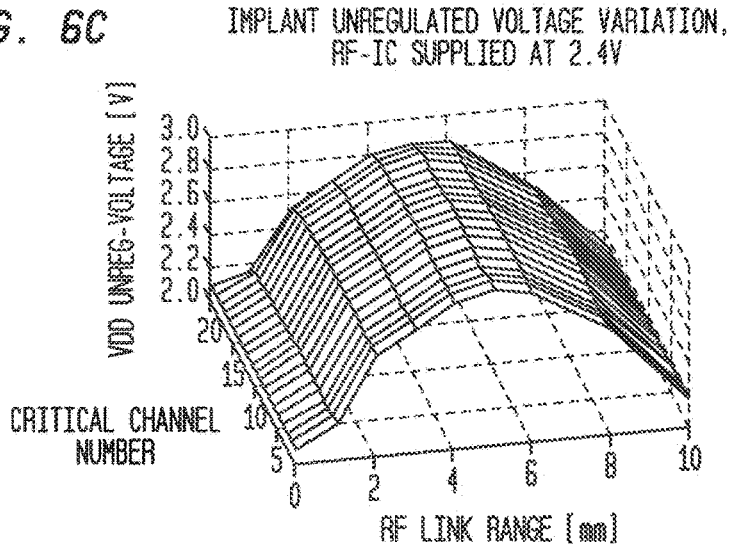

FIG. 6B is a 3D plot of the unregulated voltage 107 of the internal unit 5 as a function of link distanced, where RF IC Vdd is, e.g., 3.3V. The x-axis shows the link distanced in mm and the y-axis represents the audio band in the range of 100 to 10 kHz, expressed as critical bands 1 to 20. The z-axis shows the unregulated voltage 107 $V_{DD}$ of the internal unit 5. In these graphs, the loudness level is 120 dBSPL and wide band noise is used as a stimulus signal. FIG. 6C is a similar plot but shows the unregulated voltage 107 of the internal unit 5 as a function of d where the source voltage in the RF transmitter 10, RF IC Vdd is, e.g., 2.4 V. In both FIGS. 6B and 6C, the unregulated voltage 107 of the internal unit 5 increases to a maximum as d increases and then falls as d increases further. The peak is sharper in the case shown in FIG. 6C, and occurs at a value of approximately 5 mm; this distance is the optimal distance for the illustrated implant example, and is determined by the RF coil geometry (shape, diameter) of the internal unit 5, the RF carrier frequency, and the equivalent electrical load of the internal unit 5 that is seen by the RF transmitter 10.

Figure 7:
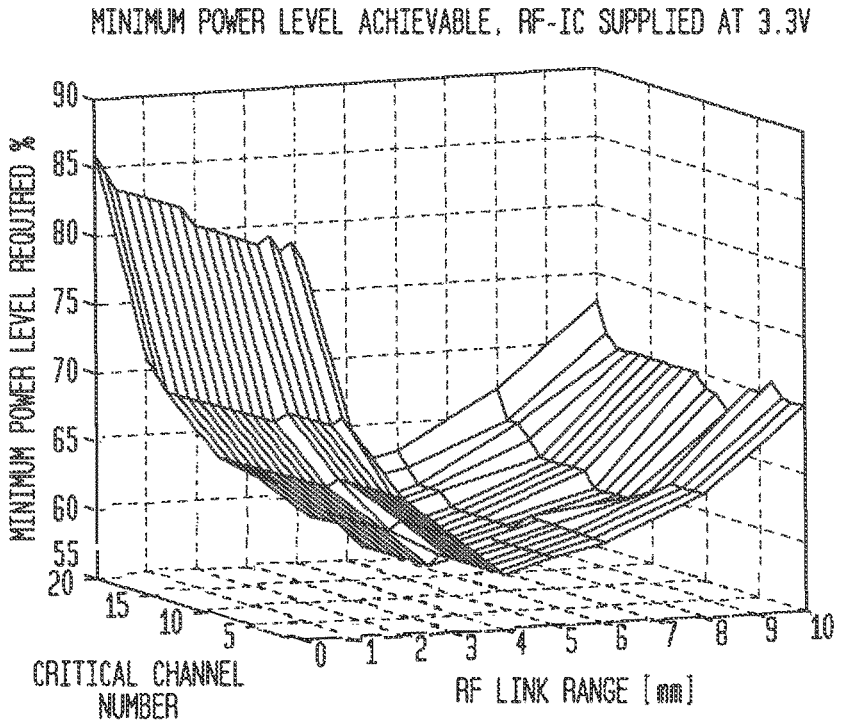
FIG. 7 is a graph plotting the minimum achievable power level in the external unit as a function of the link distance between the external and internal coils.

FIG. 7 is a three dimensional graph plotting the minimum achievable power level (PL) in the external RF transmitter 10, when the transmitter is supplied with maximum operating Voltage (e.g., Vdd=3.3V). The minimum achievable power is shown on the z-axis, in the range 55 to 90%. As in FIGS. 6A and 6B, the x-axis is the link distanced and the y-axis shows the critical bands used in the transmission. For low values of d, the achievable power level is relatively high, diminishing to a minimum level at around d of 5 mm. As d increases further, the achievable power level rises. To improve the utilization of the battery 9, the power level setting is initially pre-set to a minimum value based on parameters such as those shown in FIG. 7. The power level setting gradually increases as the battery's energy depletes over time so that the implant's operation is sustained and free of temporal interruptions. In certain embodiments, the power level setting may also be adjusted based on the type (e.g., zinc air cell, lithium, etc.) of the battery The power level adjustment is, for example, based on pulse width modulation of the signal that excites the tuned circuit in RF transmitter 10. The power level adjustment is implemented as an algorithm running in the DSP cluster 52. The link distanced is a parameter that is established during the implantation of the auditory prosthesis 1. Other critical parameters such as hearing and comfort thresholds are established by the clinician during the fitting session. The performance of the actuator 25 is characterized by its frequency response in the audible band and is expressed as the velocity magnitude over frequency. The actuator's efficiency (velocity output versus electrical power drawn) varies across frequencies and is affected by the actuator's resonance characteristic. Based on these parameters and the characteristic illustrated in FIGS. 6A to 6C, the output voltage of the voltage regulator supplying the sound processor 8 and the RF transmitter 10 is adjusted.

Other parameters that may be varied in response to predicted changes in signal levels relate to the RF signal 80. In one arrangement, e.g., the signal 80 transmitted from the external coil 11 to the internal coil 17 is an on/off modulated RF signal. The energy contained in the transmitted signal may be varied by increasing or decreasing the amplitude of the RF signal 80, for example by adjusting the tuned circuit in the RF transmitter 10. Alternatively, or in addition, the duty cycle of the on/off modulation (i.e., the width of the pulses output from the RF transmitter 10) is adjusted to vary the amount of energy transmitted to the internal unit 5.

This voltage adjustment is derived from a decision algorithm under consideration of: a) the constant operating parameters of the auditory prosthesis 1 for a given implant recipient such as the link distance d, recipient hearing and comfort thresholds, transducer efficiency/frequency response, and b) time-variant parameters such as present power-adjusting level setting, power demand indicated by the sound intensity algorithm, and the present life condition of the battery 9. The operation of the data encoder 74 may also be adjusted depending on the predicted intensity of the ambient sound.

The audio front end 50, e.g., includes a low-pass filter that limits the bandwidth of the input signal and an AID converter that converts the filtered signal into the digital signal 51. In one arrangement, e.g., the AID converter is a 16-bit circuit operating at 20 kHz. However, the sound processor 8 varies the number of bits used in the signal transmitted to the internal unit 5. For example, where there is a constant signal-to-noise ratio, if a high-intensity signal is being processed, 6 or 8 bits are used to represent the signal. If the signal intensity is lower, 12 or 16 bits are used to represent the signal.

The type of data encoding may also be varied. For example, two's complement encoding is used in general. An alternative is to use signed magnitude encoding, where a bit is used to indicate whether a number is positive or negative. The two's complement encoding may entail a higher number of bit transitions, which can lead to higher energy losses. Thus, in a lower energy mode the sound processor 8 may change to signed magnitude encoding of the digital data. Different types of digital coding with arbitrary code redundancy, varying disparity in zeros and ones can also be selected to encode the payload of the RF frames. The type of digital coding is selected dependent on the actual power demand in the implant electronics and the actuator load.

The adjustments in the system parameter settings in block 207 of method 200 can be determined by the same decision logic both for upward and downward adjustment. Alternatively, the adjustment characteristics may differ with regard to the time constant with which they are applied to the power adjusting circuits and parameters. Thus in one arrangement, e.g., the adjustment is more gradual in the downward direction and more rapid in the upward adjustment direction.

The step size of the new setting applied to the adjusting circuit depends on: the sound intensity measured relative to the current power level setting; expected power demand in the amplifier 23 and the actuator 25 for the current sound intensity; other processing sound parameters as audio signal gain, hearing and comfort thresholds; and auditory prosthesis 1 parameters such as RF coil coupling coefficient, skin flap thickness and implant operating voltage range.

The systems and methods described herein may improve the auditory prosthesis' continuous battery life by adjusting the power level as required by the individual recipient's fitting parameters, taking into account that the sound intensity modulates many power-consuming components in the prosthesis. The systems and methods disclosed herein may reduce the possibility of the recipient experiencing intermittencies in the auditory prosthesis' operation, which arise when the internal unit's average energy demand exceeds the average energy supplied by the external speech processor via the RF link.

The invention described and claimed herein is not to be limited in scope by the specific example embodiments herein disclosed, since these embodiments are intended as illustrations, and not limitations, of several aspects of the present invention. Any equivalent embodiments are intended to be within the scope of the present invention. Indeed, various modifications of the present invention in addition to those shown and described herein will become apparent to those skilled in the art from the foregoing description. Such modifications are also intended to fall within the scope of the appended claims.

What is claimed is:

1. An auditory prosthesis comprising:

a sound processor configured to measure at least one characteristic of a received sound signal and to generate an encoded signal representative thereof;

a radio frequency (RF) transmitter configured to transmit an RF signal according to the encoded signal; and a controller configured to adjust, based at least on the measured at least one characteristic of the received sound signal, at least one operating parameter of the auditory prosthesis, wherein the at least one operating parameter affects power consumption of the auditory prosthesis.

2. The auditory prosthesis of claim 1, wherein the sound processor, RF transmitter, and controller are part of an external component of the auditory prosthesis, and wherein the auditory prosthesis further comprises:

an internal unit, implantable in a recipient, including:

a receiver configured to receive the RF signal and to extract energy therefrom for powering the internal unit, a decoder that decodes data from the RF signal; and an actuator that stimulates an auditory system of the recipient based on the decoded data.

3. The auditory prosthesis of claim 1, wherein the RF signal includes an RF carrier, and wherein the controller is configured to adjust an amplitude of the RF carrier based at least on the measured at least one characteristic of the sound signal.

4. The auditory prosthesis of claim 1, wherein the transmitted RF signal includes an on/off modulated RF carrier, and wherein the controller is configured to adjust a duty cycle of the on/off modulated RF carrier based at least on the measured at least one characteristic of the sound signal.

5. The auditory prosthesis of claim 1, further comprising a voltage regulator to regulate voltage supply to the sound processor and the RF transmitter, and wherein the controller is configured to adjust an output voltage of the voltage regulator based at least on the measured at least one characteristic of the sound signal.

6. The auditory prosthesis of claim 1, wherein the RF signal comprises a sequence of frames, and wherein the controller is configured to adjust a rate at which frames in the sequence of frames are transmitted based at least on the measured at least one characteristic of the sound signal.

7. The auditory prosthesis of claim 1, wherein the sound processor utilizes a selected number of bits in generating the encoded signal, and wherein the controller is configured to adjust the selected number of bits used for generating the encoded signal based at least on the measured at least one characteristic of the sound signal.

8. The auditory prosthesis of claim 1, wherein the RF signal is transmitted in accordance with a selected type of data encoding, and wherein the controller is configured to set the selected type of data encoding for use in transmitting the RF signal based at least on the measured at least one characteristic of the sound signal.

9. The auditory prosthesis of claim 1, wherein the controller is configured to increase an energy content of the RF signal if a current or predicted acoustic level of the sound signal increases.

10. The auditory prosthesis of claim 1, wherein the controller is configured to decrease an energy content of the RF signal if a current or predicted acoustic level of the sound signal decreases.

11. The auditory prosthesis of claim 1, wherein the controller is operable to determine a step size for adjusting the at least one operating parameter of the auditory prosthesis.

12. The auditory prosthesis of claim 11, wherein the step size depends on whether adjusting of the at least one operating parameter is an increase or a decrease to the at least one operating parameter of the auditory prosthesis.

13. The auditory prosthesis of claim 11, wherein the step size is dependent on a measured sound intensity of the sound signal relative to a current power setting.

14. The auditory prosthesis of claim 11, wherein the step size is dependent on an expected power demand in an actuator or an amplifier of the auditory prosthesis.

15. The auditory prosthesis of claim 11, wherein the step size is dependent on a characteristic associated with fitting of the auditory prosthesis to a recipient, including at least one of:

an RF coil coupling coefficient between the RF transmitter and an implantable receiver;

a skin flap thickness; and an operating voltage range of an internal unit of the auditory prosthesis.

16. The auditory prosthesis of claim 1, wherein the at least one operating parameter of the auditory prosthesis is adjusted before the RF signal is transmitted.

17. The auditory prosthesis of claim 1, wherein the at least one characteristic of the sound signal includes short term variations in the sound signal and a long term intensity level of the sound signal.

18. An auditory prosthesis, comprising:

a sound processor configured to measure at least one characteristic of a sound signal received at the auditory prosthesis;

a transmitter configured to transmit an encoded signal derived from the sound signal to an internal unit implanted in a recipient; and a controller configured to adjust a at least one parameter of the encoded signal so as to vary an amount of energy transmitted in the encoded signal based on the at least one characteristic of the sound signal.

19. The auditory prosthesis of claim 18, wherein the at least one parameter includes at least one of:

a carrier amplitude of the encoded signal;

a duty cycle of the encoded signal;

a number of redundant frames in the encoded signal; a bit width used for the encoded signal; and a type of data encoding used for the encoded signal.

20. One or more non-transitory computer readable storage media encoded with instructions that, when executed by a processor, cause the processor to:

measure at least one characteristic of a received sound signal received at an auditory prosthesis and to generate an encoded signal representative thereof;

transmit a radio frequency (RF) signal according to the encoded signal; and adjust, based at least on the measured at least one characteristic of the received sound signal, at least one operating parameter of the auditory prosthesis, wherein the at least one operating parameter affects power consumption of the auditory prosthesis.

21. The non-transitory computer readable storage media of claim 20, wherein the RF signal includes an RF carrier, and wherein the instructions operable to adjust at least one operating parameter of the auditory prosthesis comprise instructions that, when executed by the processor, cause the processor to:

adjust an amplitude of the RF carrier based at least on the measured at least one characteristic of the sound signal.

22. The non-transitory computer readable storage media of claim 20, wherein the RF signal includes an on/off modulated RF carrier, and wherein the instructions operable to adjust at least one operating parameter of the auditory prosthesis comprise instructions that, when executed by the processor, cause the processor to:

adjust a duty cycle of the on/off modulated RF carrier based at least on the measured at least one characteristic of the sound signal.

23. The non-transitory computer readable storage media of claim 20, wherein the auditory prosthesis further comprises a voltage regulator, and wherein the instructions operable to adjust at least one operating parameter of the auditory prosthesis comprise instructions that, when executed by the processor, cause the processor to:

adjust an output voltage of the voltage regulator based at least on the measured at least one characteristic of the sound signal.

24. The non-transitory computer readable storage media of claim 20, wherein the RF signal comprises a sequence of frames, and wherein the instructions operable to adjust at least one operating parameter of the auditory prosthesis comprise instructions that, when executed by the processor, cause the processor to:

adjust a rate at which frames in the sequence of frames are transmitted based at least on the measured at least one characteristic of the sound signal.

25. The non-transitory computer readable storage media of claim 20, wherein the encoded signal is generated in accordance with a selected number of bits, and wherein the instructions operable to adjust at least one operating parameter of the auditory prosthesis comprise instructions that, when executed by the processor, cause the processor to:

adjust the selected number of bits used for generating the encoded signal based at least on the measured at least one characteristic of the sound signal.

26. The non-transitory computer readable storage media of claim 20, wherein the RF signal is transmitted in accordance with a selected type of data encoding, and wherein the instructions operable to adjust at least one operating parameter of the auditory prosthesis comprise instructions that, when executed by the processor, cause the processor to:

set the selected type of data encoding for use in transmitting the RF signal based at least on the measured at least one characteristic of the sound signal.

27. The non-transitory computer readable storage media of claim 20, further comprising instructions that, when executed by the processor, cause the processor to:

increase an energy content of the RF signal if a current or predicted acoustic level of the sound signal increases.

28. The non-transitory computer readable storage media of claim 20, further comprising instructions that, when executed by the processor, cause the processor to:

decrease an energy content of the RF signal if a current or predicted acoustic level of the sound signal decreases.

29. The non-transitory computer readable storage media of claim 20, further comprising instructions that, when executed by the processor, cause the processor to:

determine a step size for adjusting the at least one operating parameter of the auditory prosthesis.

30. The non-transitory computer readable storage media of claim 29, wherein the step size depends on whether the adjusting of the at least one operating parameter is an increase or a decrease to the at least one operating parameter of the auditory prosthesis.

31. The non-transitory computer readable storage media of claim 29, wherein the step size is dependent on a measured sound intensity of the sound signal relative to a current power setting.

32. The non-transitory computer readable storage media of claim 29, wherein the step size is dependent on an expected power demand in an actuator or an amplifier of the auditory prosthesis.

* * * * *